United States Patent [19]

England et al.

[11] Patent Number: 5,004,118

[45] Date of Patent: Apr. 2, 1991

[54] CONTAINER COVER

[76] Inventors: Eric England; Rick DiSalvo, both of P.O. Box 148, Fairfax, Calif. 94930

[21] Appl. No.: 445,177

[22] Filed: Dec. 4, 1989

[51] Int. Cl.[5] ..... B65D 88/34

[52] U.S. Cl. ..... 220/216; 220/225; 220/254

[58] Field of Search ..... 220/216, 225, 254

[56] References Cited

U.S. PATENT DOCUMENTS

| | | | |
|---|---|---|---|
| 2,465,755 | 3/1949 | Sanders | 220/216 |
| 2,556,195 | 6/1951 | Kors | 220/216 |
| 2,609,119 | 9/1952 | Shilstone | 220/216 |
| 4,413,747 | 11/1983 | Tenold et al. | 220/225 |
| 4,625,886 | 12/1986 | Eisenman | 220/216 |

FOREIGN PATENT DOCUMENTS

| | | | |
|---|---|---|---|
| 2832510 | 7/1980 | Fed. Rep. of Germany | 220/216 |

*Primary Examiner*—Stephen Marcus
*Assistant Examiner*—Vanessa M. Roberts
*Attorney, Agent, or Firm*—Larry D. Johnson

[57] ABSTRACT

A container cover provides a removable cover for placement on the surface of the liquid contents of a container, thereby sealing the liquid contents from the air-filled void of the container. The device includes a disc portion of a size and shape to adequately cover the liquid surface, a handle portion enabling manual grasping of the device for insertion and removal, and a reservoir member, preferably integral with the handle portion, which is saturated with an appropriate thinning agent. This reservoir member is exposed to the lower surface of the disc via perforations, so that it can replenish the volatile components otherwise lost by the liquid contents over time, thereby offsetting the effects of evaporation and oxidation.

7 Claims, 2 Drawing Sheets

CONTAINER COVER

BACKGROUND OF THE INVENTION

1. Field of the Invention

This invention relates generally to containers and related packaging, and more specifically to an improved internal cover for liquid containers and the like.

2. Description of the Prior Art

Liquid paints and coatings, such as oil-base and water-base paints, are in widespread use, and are typically packaged in buckets or cylindrical metal containers bearing "friction-plug" or other type lids enabling the resealing of the containers after initial use. However, even after such resealing, the unused paint left in the container is exposed to the air-filled void in the container, causing evaporation of the volatile components and oxidation of the non-volatile components of the remaining liquid. These processes result in the hardening of the exposed paint surface (i.e., formation of a "skin") and thickening of the remaining liquid. In addition, miscellaneous dirt and debris can fall into the container when replacing the container lid or during subsequent removal, further contaminating the remaining paint.

Several prior art devices have been developed in an attempt to to remedy this problem. Most such devices comprise a "floating" internal lid designed to rest upon the surface of the remaining liquid, thereby acting as a barrier and sealing the liquid from the air-filled void. However, even these devices permit some evaporation and/or oxidation, resulting in the undesired thickening and skin formation.

SUMMARY OF THE INVENTION

The container cover of this invention provides a removable cover for placement on the surface of the liquid contents of a container, thereby sealing the liquid contents from the air-filled void of the container. The inventive device includes a disc portion of a size and shape to adequately cover the liquid surface, i.e., having a configuration generally equal to the internal configuration of the container in which it is to be used. The device further includes a handle portion enabling manual grasping of the device for insertion and removal. In addition, the device further provides a reservoir member, preferably integral with the handle portion, which is saturated with an appropriate thinning agent (e.g., linseed oil, mineral spirits, or water, and depending upon the nature of the liquid contents of the container). This reservoir member is exposed to the lower surface of the disc via integral or created perforations, so that the thinning agent can replenish the volatile components otherwise lost by the liquid contents of the container over time, thereby offsetting the effects of evaporation and oxidation.

There are of course numerous ways to achieve this replenishing reservoir structure. In one embodiment, the handle portion forms a reservoir chamber accessible from the bottom of the disc, so that the reservoir material (e.g., sponge, foam or other porous and permeable substance) can be inserted, removed, or resaturated from the lower side of the disc. In this bottom-access reservoir handle embodiment, a reservoir seal may be used to capture the reservoir material within the chamber, which seal must be punctured or otherwise perforated before use to enable passage of the replenishing liquid or vapor into the liquid contents of the container.

Indeed, in this embodiment, the reservoir material may have been saturated with a particular thinning agent at the factory, so the the user simply punctures the seal for use.

In an alternate embodiment, the handle portion forms a reservoir chamber accessible from the top of the device via a removable cap member. In this top-access reservoir handle embodiment, permanent perforations through the disc itself and into the reservoir chamber enable the requisite passage of the replenishing liquid/-vapor.

Installation of the container cover into a previously opened and partially emptied container is accomplished in the following manner. With the bottom-access reservoir handle embodiment, the reservoir chamber seal should be cut or otherwise perforated to expose the contents of the saturated reservoir to the lower surface of the disc. With the top-access reservoir handle embodiment, the reservoir should be saturated with an appropriate thinning agent, and the removable cap placed onto the device to capture the saturated reservoir in the reservoir chamber. In either embodiment, the device is then grasped by the handle and inserted at an angle into the open container, with the flexible sides of the disc slightly deforming to enable passage through the relatively narrower inside diameter of the container lip. Once the disc has been inserted entirely into the container and past the container lip, the disc is oriented horizontally and is lightly placed on the top surface of the liquid contents. Thus, the disc portion covers the previously exposed liquid surface, and the contents of the saturated reservoir material replenish the container liquid as necessary.

To remove the container cover, the handle is grasped to lift the disc off of the paint surface, and one edge of the disc is tilted upwards towards the container lip. As the cover is extracted, the underside of the disc can be dragged across the container lip to reclaim any residual paint back into the container. The container cover can then be discarded, or cleaned and reused.

Thus, the container cover of this invention provides a simple and inexpensive tool to prevent unused liquid paint or other coating from forming a skin, thickening, or being fouled by debris. Even if a skin does develop on the paint surface over a period of time, it will adhere to the underside of the container cover itself, so that it is easily removed in one piece.

DETAILED DESCRIPTION OF A PREFERRED EMBODIMENT

Figure 1:
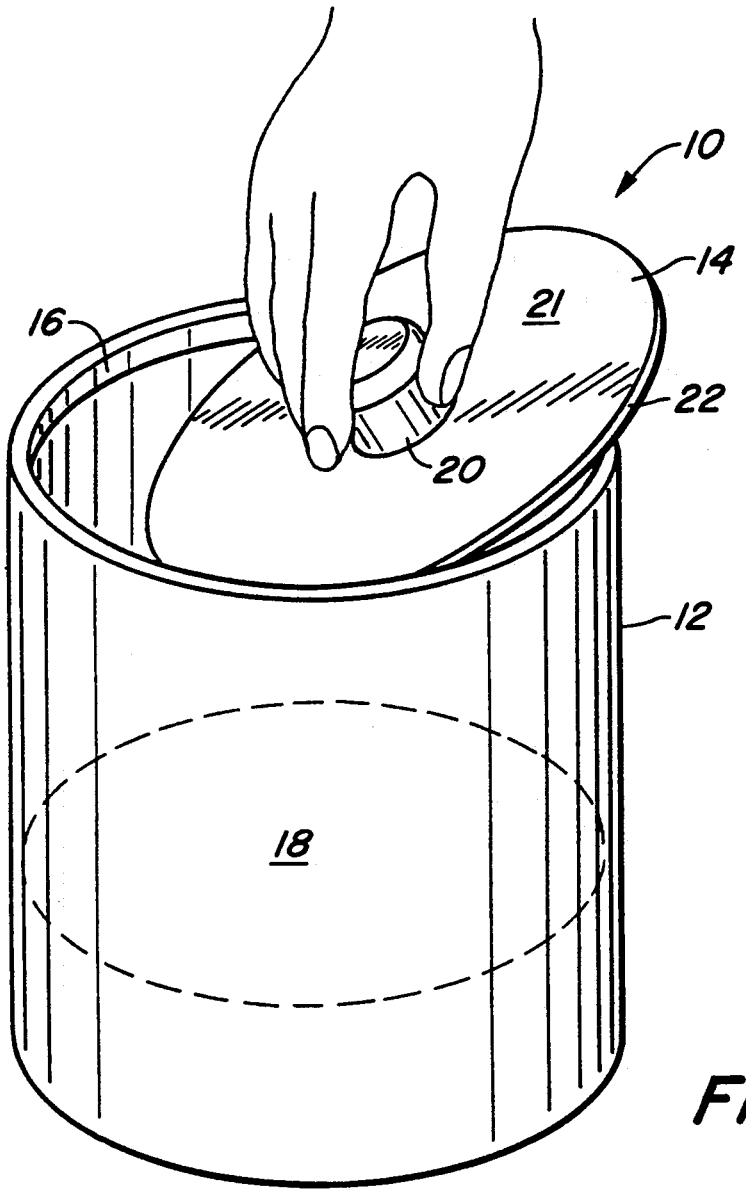
FIG. 1 is a pictorial view of a container cover of this invention being installed into an opened and partially emptied liquid container, illustrating the disc portion of the container cover being inserted past the container lip and into the container at an angle for placement upon the surface of the liquid contents therein.

FIG. 1 is a pictorial view of a container cover 10 of this invention being installed into an opened and partially emptied liquid container 12, illustrating the disc portion 14 of the container cover being inserted past the container lip 16 and into the container at an angle for placement upon the surface 18 of the liquid contents therein. Handle portion 20 is carried on disc top surface 21, and enables manual grasping of the container cover for ease of insertion and removal.

Disc portion 14 is preferably made from a semi-flexible material such as rubber, plastic, or the like, that can be deformed and return to a flat shape. Specifically, circumferential edge 22 of the disc may need to deform to pass the relatively narrower diameter of container lip 16. The disc itself is of course sized to be slightly less than the internal diameter of the container in which it is to be used. For example, with a standard one-gallon paint can, the disc should be approximately 6.43 inches in diameter.

Figure 2:
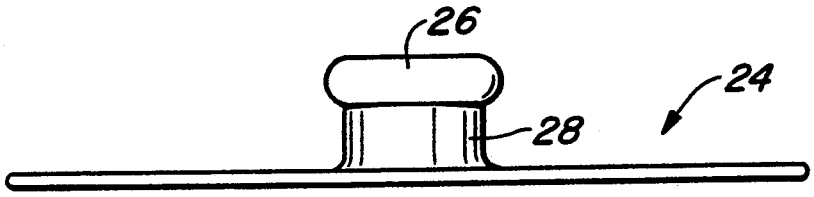
FIG. 2 is a side elevation view of a solid handle embodiment of a container cover of this invention, illustrating the flat top of the handle portion.

FIG. 2 is a side elevation view of a solid handle embodiment 24 of a container cover of this invention, illustrating the flat top 26 of the handle portion 28. In many applications, such a flat top is desirable in that it can placed upside down to rest on a flat working surface between uses of the device, so that the (paint-covered) disc edge will not touch the working surface.

Figure 3:
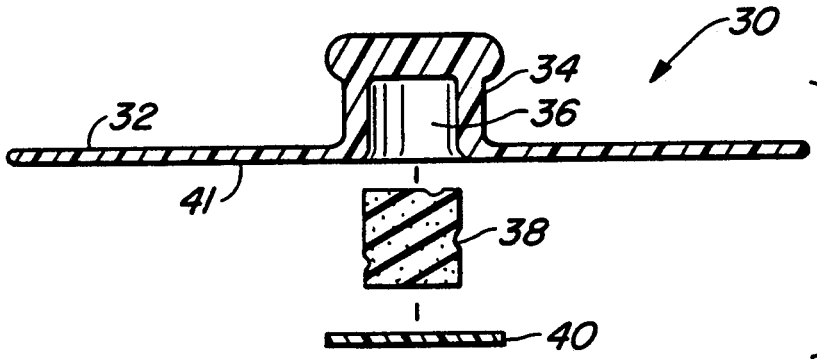
FIG. 3 is an exploded cross-sectional view of a bottom-access reservoir handle embodiment of a container cover of this invention, illustrating the disc portion, the handle portion forming a bottom-access reservoir chamber, the reservoir portion, and the seal portion.

FIG. 3 is an exploded cross-sectional view of a bottom-access reservoir handle embodiment 30 of a container cover of this invention, illustrating the disc portion 32, the handle portion 34 forming a bottom-access reservoir chamber 36, the reservoir portion 38, and the seal portion 40. In this embodiment, reservoir portion 38 may be pre-saturated with a particular thinning agent, with seal 40 to be punctured at the time of use to enable release of the thinning agent to the disc bottom surface 41, and thereby to the liquid contents of the container. Seal 40 may be made of plastic, aluminum, or other impermeable but puncturable material. Indeed, seal 40 may be replaceable, thereby enabling resaturation of the reservoir material for re-use.

Figure 4:
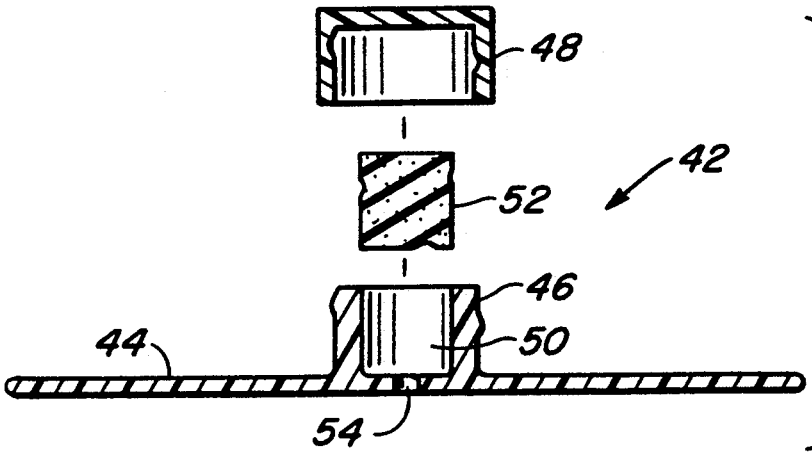
FIG. 4 is an exploded cross-sectional view of a top-access reservoir handle embodiment of a container cover of this invention, illustrating the disc portion, the handle portion and removable cap member forming a top-access reservoir chamber, the reservoir portion, and the chamber perforation.

FIG. 4 is an exploded cross-sectional view of a top-access reservoir handle embodiment 42 of a container cover of this invention, illustrating the disc portion 44, the handle portion 46 and removable cap member 48 forming a top-access reservoir chamber 50, the reservoir portion 52, and the chamber perforation 54. In this embodiment, the permanent chamber perforation enables the release of the thinning agent, obviating the need for any manual puncturing.

Figure 5:
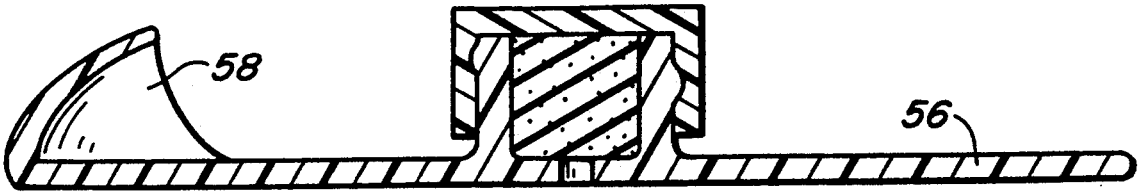
FIG. 5 is an elevated cross-sectional view of a variation of the top-access reservoir handle embodiment of FIG. 4, illustrating an alternate disc structure bearing a circumferential grip member.

FIG. 5 is an elevated cross-sectional view of a variation of the top-access reservoir handle embodiment of FIG. 4, illustrating an alternate disc structure 56 bearing a circumferential grip member 58. Such a grip member may be useful to assist in the breaking of the suction and removal of the disc from a liquid surface, particularly where a strong bond has been formed over time between the disc and the liquid contents of the container.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A cover for placement on the surface of the liquid contents of a container, said container having an inside diameter, said cover comprising:

a disc portion having a top surface and a bottom surface, said disc portion bottom surface conditioned to rest upon said liquid surface, said disc portion having a diameter slightly less than said container inside diameter;

a handle portion attached to said disc portion top surface;

a reservoir chamber attached to said disc portion, said reservoir chamber conditioned to contain a quantity of a thinning agent; and perforations enabling passage of said thinning agent from said reservoir chamber to said disc portion bottom surface, so that said thinning agent is in contact with said liquid contents of said container.

2. The cover of claim 1 including seal means for sealing said perforations.

3. The cover of claim 1 wherein said reservoir chamber is integral with said handle portion.

4. The cover of claim 1 wherein said handle portion includes a removable cap.

5. The cover of claim 1 wherein said reservoir chamber includes a porous and permeable material.

6. The cover of claim 1 wherein said disc is made of a flexible, deformable material.

7. The cover of claim 1 wherein said handle portion includes a top surface, and said top surface is flat.

* * * * *